US005328528A

United States Patent [19]

Chen

[11] Patent Number: 5,328,528

[45] Date of Patent: Jul. 12, 1994

[54] PROCESS FOR MANUFACTURING COLD-ROLLED STEEL SHEETS WITH HIGH-STRENGTH, AND HIGH-DUCTILITY AND ITS NAMED ARTICLE

[75] Inventor: Huang-Chuan Chen, Kaohsiung, Taiwan

[73] Assignee: China Steel Corporation, Taiwan

[21] Appl. No.: 33,236

[22] Filed: Mar. 16, 1993

[51] Int. Cl.[5] ..... C22C 38/12; C21D 8/00

[52] U.S. Cl. ..... 148/320; 148/603; 148/541

[58] Field of Search ..... 148/320, 603, 541

[56] References Cited

FOREIGN PATENT DOCUMENTS 55-5584 2/1980 Japan ..... 148/320

56-127732 10/1981 Japan ..... 148/603

*Primary Examiner*—Deborah Yee

*Attorney, Agent, or Firm*—Ladas & Parry

[57] ABSTRACT

The primary object of the present invention is to provide a cold-rolled steel sheet with properties of high-strength, high-ductility, and a process for manufacturing it. The constituents of the cold-rolled steel sheet comprise: 0.08%-0.25% carbon by weight, 0.03%-2.0% silicon by weight, 0.6%-1.8% manganese by weight, 0.01%-0.10% niobium by weight, 0.01%-0.08% aluminium by weight, with the rest being substantially iron and unnoticed impurities. The process for manufacturing cold-rolled steel sheets of the present invention by using the molten steel material as described above includes the following steps:

(a) preparing steel ingots by continuous casting the molten steel;

(b) hot rolling the steel ingots into hot-rolled bands;

(c) coiling the hot-rolled bands at a temperature below 600° C.;

(d) after cold-rolling, forming steel sheets from the hot-rolled bands and soaking the steel sheets at a temperature in the two-phase range (equal to AC1+10° C.-AC3-10° C. shown in FIG. 1) for a time duration ranging from 1 minute to 10 minutes;

(e) cooling the steel sheets to a temperature ranging from 350° C. to 500° C. at a cooling rate greater than 50° C./SEC;

(f) soaking the steel sheets at a temperature ranging from 350° C. to 500° C. for a time duration from 1 minute to 10 minutes;

(g) cooling the steel sheets by air so as to form the cold-rolled steel sheets having a microstructure of ferrite plus residual austenite plus bainite (or a small amount of martensite).

2 Claims, 1 Drawing Sheet

PROCESS FOR MANUFACTURING COLD-ROLLED STEEL SHEETS WITH HIGH-STRENGTH, AND HIGH-DUCTILITY AND ITS NAMED ARTICLE

BACKGROUND OF THE INVENTION

The present invention relates to a cold-rolled steel sheet with properties of high-strength, high-ductility, and a process for manufacturing the cold-rolled steel sheet. Particularly, the present invention relates to the cold-rolled steel sheet having chemical compositions of 0.08%–0.25% carbon by weight, 0.3%–2.0% silicon by weight, 0.6%–1.8% manganese by weight, 0.01%–0.10% niobium by weight, 0.01%–0.08% aluminium by weight, substantial iron, and unnoticed impurities, and a process for manufacturing it. The tensile strength TS of the cold-rolled steel sheet described above is more than 690 MPa, and the formability is excellent.

Recently, cold-rolled steel sheets of high-strength, tensile strengths of about 440 MPa–690 MPa, and thicknesses of about 0.8 mm–1.6 mm have been used in bumpers and side-doors of automobiles in consideration safety of car passenger and lighting the weight of automobiles so as to minimize the fuel consumption. Many kinds of cold-rolled steel sheets of high-strength have been continuously developed so far, such as solid-solution hardened steel, precipitation hardened steel, recovery-annealed steel, dual-phase steel, full martensitic steel, and multi-phase steel containing retained austenite. However, each kind has its drawbacks which are listed below:

(1) Solid-Solution Hardened Steel

Rephosphorus steel is the most popular steel for manufacturing the outer panel of an automobile. It is cheap, but the greatest tensile strength only reaches 440 MPa. Although there are steels manufactured by adding silicon or manganese into the matrix of rephosphorus steels so as to enhance the tensile strength to 590 MPa, it is very difficult to use solid solution for hardening steel to a tensile strength larger than 690 MPa.

(2) Precipitation Hardened Steel

Elements such as titanium, niobium, or vanadium easily combine with elements such as carbon or nitrogen so as to form a carbide or a nitrogen compound. By the precipitation process, the hardness of the steel may be enhanced to a strength about 690 MPa. However, the ductility is greatly lowered.

(3) Recovery-annealed Steel

After cold-rolled, steel sheets are recovery-annealed at a temperature below the recrystallization temperature to manufacture recovery-annealed steel sheets. Because there is no recrystallization to form ferrite, a tensile strength of 690 MPa is attainable. However, the ductility of the steel is bad and the steel is difficult to deform. In addition, if titanium is added into the matrix of the steel, the recrystallization temperature may be increased to the two-phase region. By use of a recovery-annealing at a temperature in the two-phase region, then cooling quickly, a compound composition steel having the microstructure of ferrite which is not recrystallized plus martensite (or bainite) may be obtained. However, even though the strength and ductility may be improved, the titanium alloy is so expensive that manufacturing costs and selling prices will greatly increase. Furthermore, the improvement in ductility is small.

(4) Dual-phase steel

Dual-phase steel, a compound composition steel, obtained by maintaining a temperature in the two-phase region for a period of time and then cooling quickly to form the microstructure of ferrite plus martensite, is a popular steel that has been researched for the last couple of decades. The n value (index of strain hardening) of the dual-phase steel is high, and the work hardening rate is fine. However, the r value (plastic deformation ratio) of the dual-phase steel is low, and its drawability is bad. Although the strength and ductility of this steel are good, its value of TS*EL (tensile strength * elongation percentage) is less than 20,000 MPa. %. It still needs to be improved.

(5) Full Martensitic Steel

Full martensitic steel is obtained by maintaining a temperature in austenite phase region and then cooling quickly. The strength of the full martensitic steel is very good, but the ductility thereof is bad and this kind of steel is difficult to deform.

(6) multi-phase steel (containing a large amount of austenite)

Multi-phase steel, a compound composition steel, obtained by maintaining a temperature in the two-phase region for a period of time, then cooling to a temperature just above the Ms (the temperature at which the martensite transformation starts) point for proceeding with the bainite transformation treatment, and then cooling by air so as to form a microstructure of ferrite plus retained austenite plus bainite (or a small amount of martensite). Because of Transformation Induced Plasticity (abbreviated as TRIP), multi-phase steel has excellent strength and ductility, and the value of TS*EL is greater than 20,000 Mpa. %, so that it is presently the best steel of all. However, in order to gain a lot amount of retained austenite, the carbon content of conventional multi-phase steel is usually more than 0.25% by weight. Moreover, a great deal of silicon and manganese must be added to the matrix of the steel so that the welding carbon equivalent usually exceeds 0.5, making this kind of steel difficult to weld.

To solve this difficulty in welding, the inventor of the present invention has invented a kind of steel, wherein the carbon content of the steel is decreased to 0.08%–0.25% by weight and phosphorus is added into the matrix of the steel so as to increase its strength. This invention, titled "Method of Producing a Multi-Phase Structured Cold Rolled High-tensile Steel Sheet", has been granted a patent issued as U.S. Pat. No. 4,854,976 in 1989.

The rephosphorus steel described above has high-strength, high-ductility, and is easy to weld. However, because phosphorus segregates to the grain boundary easily, thereby weakening the strength of the grain boundary, the rephosphorus steel may be brittle where used at low temperature. Although brittleness may be improved by adding boron into the matrix of the steel, this greatly increases production costs.

SUMMARY OF THE INVENTION

Accordingly, the main object of the present invention is to improve defects of the rephosphorus low carbon steel described above by adding 0.01%-0.10% niobium by weight to the matrix of the low carbon steel containing 0.08%-0.25% carbon by weight to replace the phosphorus which may cause the grain boundary to be brittle. At the same time, silicon, manganese, and aluminium are added to the matrix of the steel. Since adding niobium results in a fine grain, after appropriate rolling and heat treatment, cold-rolled steel sheets containing more than 8% of retained austenite by volume fraction may be obtained, that display high-strength and high-ductility.

It is another object of the present invention to provide a cold-rolled steel sheet, the constituents of the cold-rolled steel sheet comprising: 0.08%-0.25% carbon by weight, 0.03%-2.0% silicon by weight, 0.6%-1.8% manganese by weight, 0.01%-0.10% niobium by weight, 0.01%-0.08% aluminium by weight for deoxygenation used in making steel, with the rest being substantially iron and unnoticed impurities. In accordance with the present invention, a process for manufacturing cold-rolled steel sheets having properties of high-strength and high-ductility by using the molten steel material as described above includes the following steps:

(a) preparing steel ingots by continuous casting the molten steel;
(b) hot rolling the steel ingots into hot-rolled bands;
(c) coiling the hot-rolled bands at a temperature below 600° C.;
(d) after cold-rolling, forming steel sheets from the hotrolled bands and soaking the steel sheets at a temperature ranging from AC1+10° C. to AC3−10° C. for a time duration ranging from 1 minute to 10 minutes;
(e) cooling the steel sheets to a temperature ranging from 350° C. to 500° C. at a cooling rate greater than 50° C./SEC;
(f) soaking the steel sheets at a temperature ranging from 350° C. to 500° C. for a time duration from 1 minute to 10 minutes;
(g) cooling the steel sheets by air so as to form the cold-rolled steel sheets with properties of high-strength, high-ductility, having the microstructure of ferrite plus retained austenite plus bainite (or a small amount of martensite).

BRIEF DESCRIPTION OF THE DRAWING

The present invention can be better understood by reference to the following description and accompanying drawing of preferred embodiments of the present invention.

DETAILED DESCRIPTION OF THE PREFERRED EMBODIMENTS

Figure 1:
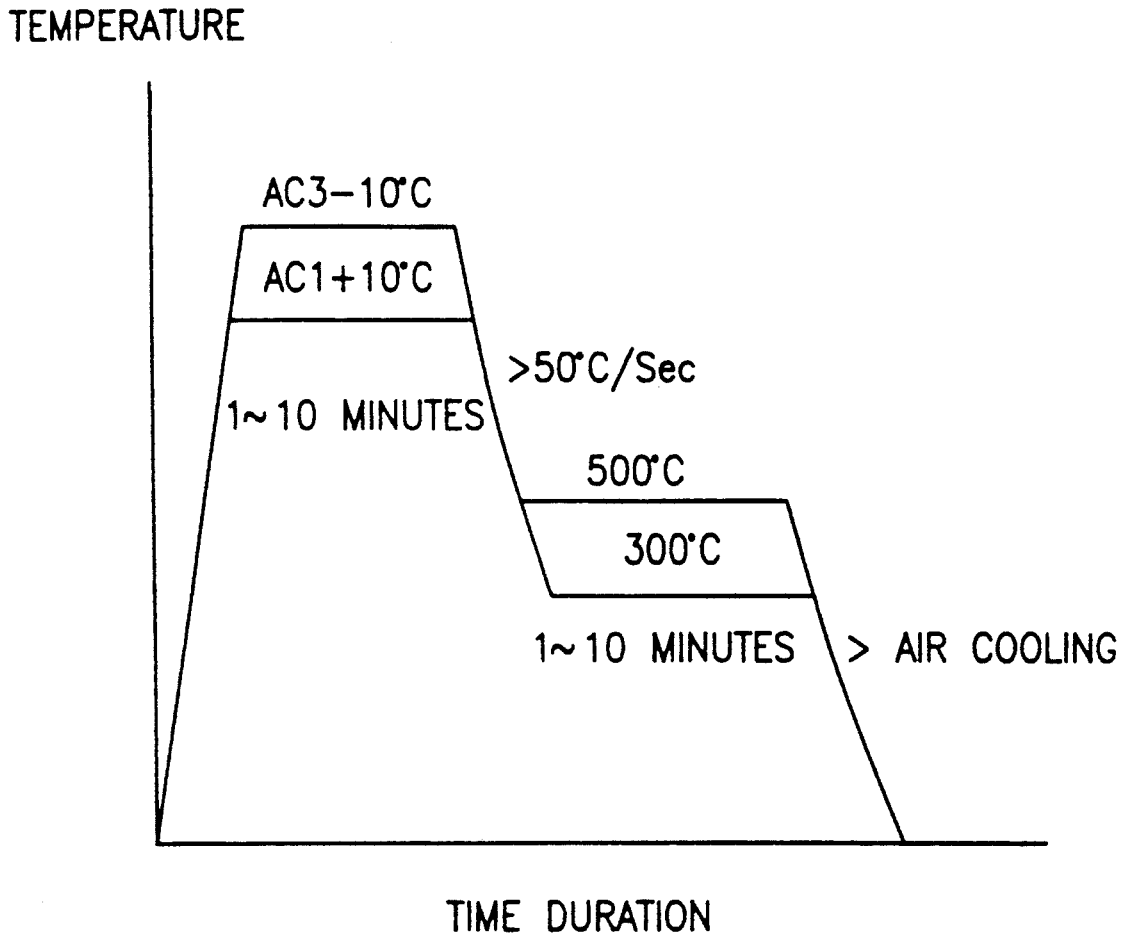
FIG. 1 is a diagram showing the relationship between temperature and time duration during heat treatment of the steel of the present invention.

It is an aspect of the present invention to improve the brittleness of rephosphorus steel by adding niobium to the steel. Since adding niobium results in a fine grain, after appropriate rolling and treatment, cold-rolled steel sheets containing more than 8% of retained austenite by volume fraction may be obtained, and have the properties of high-strength and high-ductility.

The process of manufacturing the steel sheet of the present invention will be described with reference to FIG.1. The process includes the following steps:

(a) preparing a molten steel which contains 0.08%-0.25% carbon by weight, 0.03%-2.0% silicon by weight, 0.6%-1.8% manganese by weight, 0.01%-0.10% niobium by weight, 0.01%-0.08% aluminium by weight for deoxygenation used in making steel, with the rest being substantially iron and unnoticed impurities.
(b) preparing steel ingots by continuous casting the molten steel;
(c) hot rolling the steel ingots into hot-rolled bands;
(d) coiling the hot-rolled bands at a temperature below 600° C.;
(e) after cold-rolling, forming steel sheets from the hot-rolled bands and soaking the steel sheets at a temperature ranging from AC1+10° C. to AC3−10° C. for a time duration ranging from 1 minute to 10 minutes;
(f) cooling the steel sheets to a temperature ranging from 350° C. to 500° C. at a cooling rate greater than 50° C./SEC;
(g) soaking the steel sheets at a temperature ranging from 350° C. to 500° C. for a time duration from 1 minute to 10 minutes;
(h) cooling the steel sheets by air so as to form the cold-rolled steel sheets with properties of high-strength, high-ductility, having the microstructure of ferrite plus retained austenite plus bainite (or a small amount of martensite).

The constituents of the steel and the conditions of treatment are strictly limited, and the following is the reasons for limitation.

Reasons for the Limitation of Constituents

(1) Carbon

In order to gain high tensile strength, the amount of carbon has to be limited to 0.08% by weight at least, furthermore, to have a greater amount of retained austenite, it is better that the amount of carbon be more than 0.10% by weight. However, when the amount of carbon is over 0.25% by weight, the welding carbon equivalent is so large that it is difficult to weld the steel. Thus, it is preferable to limit the amount of carbon to within 0.08%-0.25% by weight.

(2) Silicon

The silicon has the effect of deoxygenation and enhancing the strengthening effect by solid solution, yet itself does not stabilize the retained austenite. However, in the process of annealing the steel at a temperature in the two-phase region and then cooling to a temperature ranging from 350° C. to 500° C., when the added amount of silicon exceeds 0.3% by weight, it will increase the formation of proeutectoid ferrite, and expel the carbon in the proeutectoid ferrite to the austenite so that the carbon concentration in the austenite will increase, thus increasing the stability of the austenite and enhancing the amount of retained austenite after cooling. However, when the amount of silicon exceeds 2.0% by weight, it causes defects on the surface of ingots or difficulties in pickling or welding. Thus, it is preferable to limit the amount of silicon to within 0.3%-2.0% by weight.

(3) Manganese

The manganese is an important element to form the retained austenite. The manganese content of the steel has to exceed 0.6% by weight so as to have the effect of clearly increasing the amount of retained austenite. However, if the amount of manganese is over 1.8% by weight, the hardenability of the steel is obviously enhanced, and the microstructure of the steel readily transforms from austenite to martensite while cooling, consequently causing the amount of retained austenite to decrease. Thus, it is preferable to limit the amount of manganese to within 0.6%-1.8% by weight.

(4) Niobium

The adding of niobium is the main characteristic of the present invention because it is capable of increasing the amount of retained austenite. The reason why niobium can increase the amount of retained austenite is that the microstructure of the steel will form fine niobium carbide precipitates while adding more amount of niobium than 0.01% by weight, and these precipitates will decrease the grain growth to form a fine grain. When the steel is cooled by annealing to a temperature between 350° C. and 500° C., fine grain steel will form larger amount of proeutectoid ferrite, hence there will be a greater concentration of carbon in austenite to enhance its stability. However, when the amount of niobium exceeds 0.10% by weight, too much carbon in the steel will be consumed, causing the amount of retained austenite to decrease. Moreover, if too much niobium carbide precipitates, the ductility of the steel will be diminished. Thus, it is preferable to limit the amount of niobium to within 0.01%-0.10% by weight.

(5) Aluminium

Aluminium is used for deoxygenation of the steel in the process of making steel. When the amount of aluminium is less than 0.01% by weight, it is insufficient for deoxygenation, while when the amount of aluminium exceeds 0.08% by weight, the surface flatness of the steel will be impaired. Thus, it is preferable to limit the amount of the aluminium to within 0.01%-0.08% by weight.

Reasons for the Limitation of the Conditions of Treatment (1) Coiling Temperature The coiling temperature is an important factor in the process of the present invention. If coiling takes place at a temperature lower than 600° C., a fine pearlite will be obtained, that is, due to the layer distance of the cementite which is in pearlite become shorter, the pearlite will easily transform into austenite while annealing at two-phase region after the steel is cold-rolled. Thus, the amount of retained austenite will be enhanced due to later cooling and transformation treatment. If the coiling takes place at a temperature higher than 600° C., cementite will coarsen at the grain boundary, and a small amount of retained austenite will be obtained while annealing at a temperature in the two-phase region after being cold-rolled, and the amount of retained austenite will be decreased after cooling.

(2) Heat Treatment Conditions

FIG. 1 shows the heat treatment conditions which have to be observed according to the present invention. After maintained a temperature in the two-phase region (equal to AC1+10° C. to AC3−10° C. shown in FIG. 1, wherein AC1 is the beginning temperature of austenization while AC3 is the final temperature of austenization) for a period of time, then the steel is directly cooled to a temperature in the bainite transformation range for a period of time, and then the steel is cooled by air. These are the heat treatment processes for obtaining steel with properties of high-strength and high-ductility, which has a microstructure of ferrite plus retained austenite plus bainite (or a small amount of martensite). The following are reasons for limiting the conditions of the process.

(a) Two-phase Region Heat Treatment

When the annealing temperature is lower than AC1+10° C. or the time duration during soaking in the two-phase region is less than 1 minute, the pearlite will not austenizate easily so that little austenite is obtained after cooling. On the contrary, when the annealing temperature is higher than AC3−10° C. or the time duration during soaking in the two-phase region is greater than 10 minutes, the amount of the austenite increases a lot and the concentration of carbon in the austenite decreases. This results in diminished stability of the austenite, and decreases the amount of retained austenite after cooling.

(b) Bainite Transformation Temperature Region Heat Treatment

When the steel is cooled to the bainite transformation temperature region for treatment, the cooling rate has to be greater than 50° C./SEC, or the austenite will transform into pearlite, making it less possible to obtain retained austenite. When the cooling rate is greater than 50° C./SEC, it will inhibit the formation of pearlite and promote the transformation of proeutectoid ferrite. While undergoing treatment in bainite transformation temperature region, the carbon in proeutectoid ferrite will diffuse to the austenite. If the time duration of treatment is too short, the carbon concentration in the austenite diffused from proeutectoid ferrite will be insufficient. Conversely, if the time duration of treatment is too long, almost all of the austenite will transform into bainite. Thus, it is preferable to maintain the time duration between 1 minute and 10 minutes. Additionally, if the treatment temperature is over 500° C., the austenite will transform into pearlite, and if the treatment temperature is below 350° C., the austenite will transform into martensite. Thus, it is preferable to limit the treatment temperature to within 350° C.-500° C.

Please refer to FIG. 1 and attached Tables. Table 1 shows the constituents and heat treatment processes of various steels. Table 2 shows the mechanical properties and microstructures of the steels listed in Table 1. Test pieces No.1, No.2, and No.3 are steels of the present invention, all of which are cold-rolled steel sheets having microstructures of ferrite (F) plus retained austenite ($\gamma$R) plus bainite (B) (or a small amount of martensite). The tensile strengths of test No.1, No.2, and No.3 are over 690 MPa, and the value of tensile strength multiply elongation percentage (the value of TS,EL) are higher than 22,000 MPa. %.

Although the heat treatment conditions accord with the conditions of the present invention, yet sufficient amount of retained austenite (7% by weight normally) can not be obtained for lack of niobium. Therefore, the tensile strength of test No.4 is lower than 690 MPa. The constituents of test No.5 and test No.3 are the same, but the time duration maintained at a temperature of 440° C. is so long (i.e., if exceeds the predetermined 10 minutes of the present invention) that there is little retained austenite. Therefore, the elongation percentage of test No.5 is bad, and the value of TS,EL is less than the steels of the present invention. The constituents and treatment process of tests No.6 and No.7 are not in conformity to the present invention (the cooling rate of test No.6 is less than 50° C./SEC, the austenization temperature of test No.7 is higher than AC3). The carbon content of these two steels is obviously rich, yet still no retained austenite is obtained. Although the tensile strengths of tests No.6 and No.7 are enhanced due to the increment of carbon, yet the ductilities are poor, and the values of TS,EL are less than the steels of the present invention. From Table 2, it can be discovered that at the same tensile strength, the ductility of the steels of the present invention compared with that of the comparison steels is capable of being obviously improved. This effect mainly results from the Transformation Induced Plasticity (TRIP) of the retained austenite.

TABLE 1

| No. of steel | C | Si | Mn | P | S | Al | Nb | Heat Treatment | Remarks |
|---|---|---|---|---|---|---|---|---|---|
| 1 | 0.16 | 0.53 | 1.50 | 0.011 | 0.008 | 0.036 | 0.034 | ♦ | Steels of the |
| 2 | 0.20 | 1.32 | 0.97 | 0.012 | 0.010 | 0.041 | 0.037 | Same as Above | Present Invention |
| 3 | 0.19 | 1.36 | 1.02 | 0.015 | 0.009 | 0.042 | 0.077 | Same as Above | |
| 4 | 0.18 | 0.80 | 0.95 | 0.013 | 0.010 | 0.045 | 0.002 | Same as Above | Steels for |
| 5 | 0.19 | 1.36 | 1.02 | 0.015 | 0.009 | 0.042 | 0.077 | ♥ | Comparison |
| 6 | 0.29 | 0.18 | 0.48 | 0.012 | 0.009 | 0.035 | — | ♦ | |
| 7 | 0.50 | 0.07 | 0.80 | 0.017 | 0.011 | 0.038 | — | ♠ | |

♦ : Soaking at 800° C. for 2.5 minutes, then cooling to 440° C. at a rate of 70° C./SEC, then soaking at 440° C. for 5 minutes, then cooling by air ♥ : Soaking at 800° C. for 2.5 minutes, then cooling to 440° C. at a rate of 70° C./SEC, then soaking at 440° C. for 12 minutes, then cooling by air ♦ : Soaking at 870° C. for 1 minute, then cooling to 400° C. at a rate of 45° C./SEC, then soaking at 400° C. for 3 minutes, then cooling by air ♠ : Soaking at 900° C. for 1 minute, then cooling to 400° C. at a rate of 100° C./SEC, then soaking at 400° C. for 3 minutes, then cooling by air

TABLE 2

| No. of steel Piece | Yield Strength YS (MPa) | Tensile Strength TS (MPa) | Elongation EL (%) | TS*EL (MPa. %) | Residual Amount of Austenite (%) | Microstructure | Remarks |
|---|---|---|---|---|---|---|---|
| 1 | 500 | 715 | 32 | 22,880 | 10 | F + γR + B | Steels of the |
| 2 | 490 | 725 | 34 | 24,650 | 13 | F + γR + B | Present Inbention |
| 3 | 495 | 730 | 33 | 24,090 | 12 | F + γR + B | |
| 4 | 440 | 680 | 27 | 18,360 | 5 | F + γR + B | Steels for |
| 5 | 550 | 720 | 25 | 18,000 | 0 | F + B | Comparison |
| 6 | 637 | 745 | 25 | 18,625 | 0 | F + B | |
| 7 | 784 | 931 | 19 | 17,690 | 0 | F + B | |

F: Ferrite, γR: Retained Austenite, B: bainite

While the present invention has been described in terms of what is presently considered to be the most practical and preferred embodiments, it is to be understood that the invention need not be limited to the disclosed embodiments. On the contrary, it is intended to cover various modifications and similar arrangements included within the spirit and scope of which should be accorded the broadest interpretation so as to encompass all such modifications and similar structures.

What is claimed is:

1. A cold-rolled steel sheet consisting essentially of: 0.08%–0.25% carbon by weight, 0.3%–2.0% silicon by weight, 0.6%–1.8% manganese by weight, 0.01%–0.10% niobium by weight, 0.01%–0.08% aluminium by weight, substantial iron, and unnoticed impurities and having a microstructure with at least 8% retained austenite by volume fraction.

2. A process for manufacturing cold-rolled steel sheets with properties of high-strength and high-ductility, by using the molten steel material as recited in claim 1, comprising the following steps:

(a) preparing steel ingots by continuous casting the molten steel;

(b) hot rolling the steel ingots into hot-rolled bands;

(c) coiling the hot-rolled bands at a temperature below 600° C.;

(d) after cold-rolling, forming steel sheets from the hotrolled bands and soaking the steel sheets at a temperature ranging from AC1+10° C. to AC3−10° C. for a time duration ranging from 1 minute to 10 minutes;

(e) cooling the steel sheets to a temperature ranging from 350° C. to 500° C. at a cooling rate greater than 50° C./SEC;

(f) soaking the steel sheets at a temperature ranging from 350° C. to 500° C. for a time duration from 1 minute to 10 minutes;

(g) cooling the steel sheets by air so as to form the cold-rolled steel sheets.

* * * * *